US007864008B2

(12) United States Patent
Schilling

(10) Patent No.: US 7,864,008 B2
(45) Date of Patent: Jan. 4, 2011

(54) SOLENOID ASSEMBLY WITH SHOCK ABSORBING FEATURE

(75) Inventor: Ronald J. Schilling, Waterford, WI (US)

(73) Assignee: Deltrol Controls, Milwaukee, WI (US)

( * ) Notice: Subject to any disclaimer, the term of this patent is extended or adjusted under 35 U.S.C. 154(b) by 196 days.

(21) Appl. No.: 12/255,730

(22) Filed: Oct. 22, 2008

(65) Prior Publication Data

US 2010/0097165 A1 Apr. 22, 2010

(51) Int. Cl.
*H01F 7/08* (2006.01)

(52) U.S. Cl. ..... 335/257; 335/255; 335/220; 251/129.15

(58) Field of Classification Search ..... 335/220–229, 335/255, 257; 251/129.01–129.22
See application file for complete search history.

(56) References Cited

U.S. PATENT DOCUMENTS 4,217,507 A * 8/1980 Jaffe et al. ..... 310/12.07
4,835,503 A * 5/1989 Everett ..... 335/229
5,268,662 A * 12/1993 Uetsuhara et al. ..... 335/229
6,242,994 B1 * 6/2001 Li et al. ..... 335/277
2001/0023876 A1 * 9/2001 Estelle et al. ..... 222/146.5
2003/0030524 A1 * 2/2003 Sato et al. ..... 335/220
2004/0201442 A1 * 10/2004 Herbert et al. ..... 335/220

* cited by examiner

*Primary Examiner*—Anh T Mai
*Assistant Examiner*—Bernard Rojas
(74) *Attorney, Agent, or Firm*—Andrus, Sceales, Starke & Sawall, LLP

(57) ABSTRACT

A solenoid assembly includes a solenoid having a coil provided with a passageway and a plunger movable within the passageway upon application of electrical power to the coil. A frame holds the solenoid and includes a backstop movably mounted in the frame extending into the coil passageway. The backstop is selectively engaged by the plunger such that the backstop and the plunger are subjected to an impact therebetween. A resilient dampening element is positioned between the frame and the backstop for cushioning the impact between the backstop and the plunger.

19 Claims, 2 Drawing Sheets

SOLENOID ASSEMBLY WITH SHOCK ABSORBING FEATURE

FIELD OF THE INVENTION

The present invention relates broadly to electromagnetic control devices, and more particularly, pertains to a solenoid assembly having a cushioning arrangement for maintaining the integrity of a plunger moving within the solenoid.

BACKGROUND OF THE INVENTION

As is well known, a solenoid assembly consists essentially of a coil of wire or winding that is wrapped around a hollow bobbin. An enclosure or frame made of a magnetically conductive material normally contains the coil. An actuator or plunger moves back and forth within a passageway formed in the bobbin. Application of electrical power to the coil will move the plunger between an energized, latched position and a de-energized, unlatched position. A return spring is provided to assist movement of the plunger back to the unlatched position. Typically, the plunger is designed with some sort of feature which allows users to connect whatever structure they would need to actuate with it. At one end of the solenoid assembly in the passageway of the bobbin and rigidly attached to the frame is a slug of magnetic material known as a backstop. The backstop establishes the maximum pulling distance the plunger can achieve when the coil is energized by electrical power. The coil is normally wound to parameters that will dictate the amount of electromagnetic forces placed upon the plunger based upon a desired application.

When a solenoid coil is momentarily energized, the electromagnetic energy causes the plunger to move towards the backstop into the latched position compressing the return spring. As the plunger approaches the backstop, its level of force generally increases. When the plunger impacts and bottoms out on the backstop, the maximum amount of pulling power is achieved. In a magnetic latching solenoid, power to the coil is removed and a set of permanent magnets in the frame is used to hold the plunger in its latched position. When it is desired to move the plunger to an unlatched position, the solenoid coil is momentarily energized to overcome the force of the permanent magnets after which release of the compressed spring force completes the return movement of the plunger.

In certain high wattage applications when the solenoid is moved to the latched position, the plunger imposes a large impact loading upon the rigidly connected backstop. Upon repeated use, this impact loading deforms the plunger such that movement of the plunger is impaired leading to the failure in the solenoid performance.

Accordingly, it is desirable to provide a solenoid assembly which avoids failures due to destructive impact loading between the plunger and backstop. More specifically, it is desirable to provide the solenoid assembly with a modified connection between the backstop and the frame, and position a shock absorbing element between the backstop and the frame to prevent damage to the plunger over repeated cycles of use and extend the service life of the solenoid assembly.

SUMMARY OF THE INVENTION

The present invention relates to a solenoid assembly including a solenoid having a coil provided with a passageway and a plunger movable within the passageway upon application of the electrical power to the coil. A frame holds the solenoid and includes a backstop extending into the coil passageway. The backstop is selectively engaged by the plunger such that the backstop and plunger are subject to an impact therebetween. A resilient dampening element is positioned between the frame and the backstop for cushioning the impact between the backstop and the plunger.

In the preferred embodiment, the backstop is movably mounted relative to the frame. The resilient dampening element is an O-ring encircling the plunger. A solenoid assembly includes holding elements for maintaining a prescribed position of the plunger. The holding elements include a pair of permanent magnets surrounding a portion of the coil and positioned adjacent one end of the coil in the frame. The holding elements further include a spring positioned between the frame and the plunger.

In another aspect of the invention, a solenoid assembly includes a solenoid having a coil provided with a passageway, and a plunger movable within the passageway upon application of electrical power to the coil between a latched position and an unlatched position. A magnetic latching arrangement surrounds the plunger and is positioned adjacent the coil for holding the plunger in the latched position. A frame holds the coil and the magnetic latching arrangement and includes a separate backstop movably mounted in the frame and extending into the coil passageway. The backstop is selectively engaged by the plunger such that the backstop and plunger are subject to an impact therebetween. A spring surrounds the plunger for normally biasing the plunger to the unlatched position. A resilient, shock absorbing ring encircles the backstop and is positioned between the backstop and the frame for preventing damage to the plunger upon impacting the backstop.

The magnetic latching arrangement includes a pair of permanent magnets encircling the plunger and a portion of the coil. The plunger has a main body, an outer end projecting from the frame and an inner end engageable with the backstop. The frame includes a pair of sidewalls connected by a back wall having a recess formed therein. The frame further includes an end plate connecting the sidewalls and spaced from the back wall. The backstop has a first cylindrical portion positioned in the passageway of the coil, and a second cylindrical portion mounted in the recess of the back wall. The inner end of the plunger has an circumferential shoulder engageable with a circular inner end of the backstop. The backstop is formed with an aperture which receives a portion of the inner end of the plunger. The backstop is restrained from moving inwardly in the passageway by a ring retained on the second cylindrical portion of the plunger and engaged against the frame. The shock absorbing ring is located between the first and second cylindrical portions of the backstop. The impact between the plunger and the backstop causes the ring to compress and enable movement of the backstop. A washer surrounds the main body of the plunger. The spring has one end positioned against the washer and another end engaged against the frame.

BRIEF DESCRIPTION OF THE DRAWINGS

The drawings illustrate the best mode presently contemplated of carrying out the invention.

In the drawings.

DETAILED DESCRIPTION OF THE PREFERRED INVENTION

Figure 1:
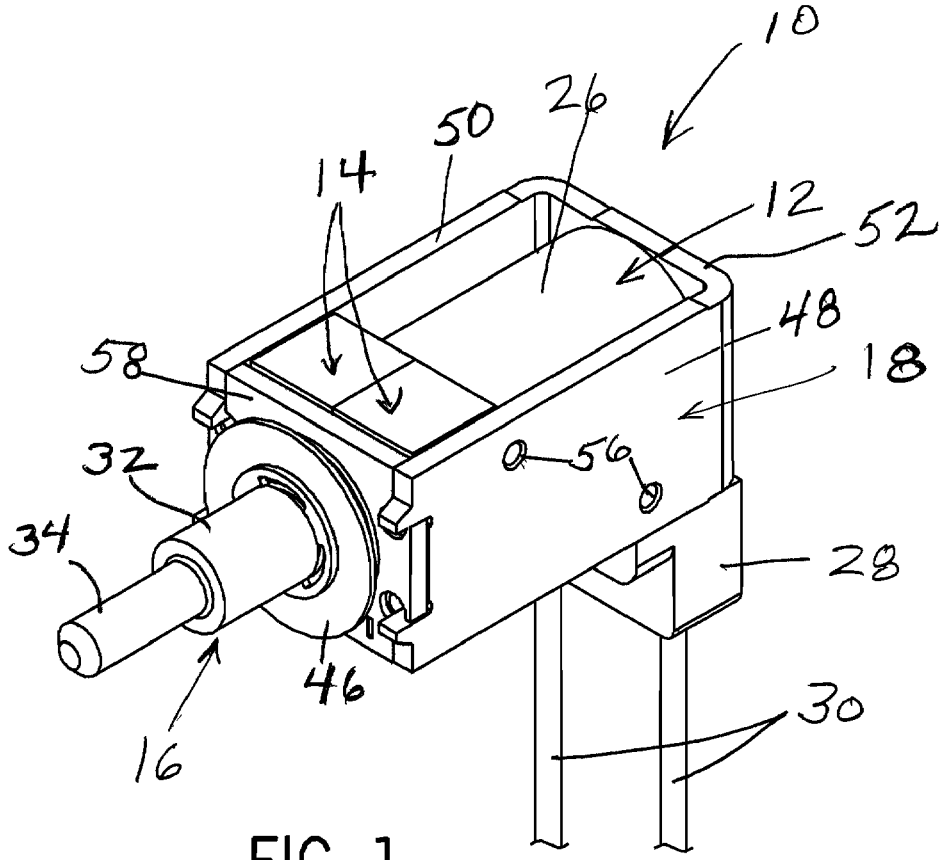
FIG. 1 is a perspective view of a solenoid assembly provided with a shock absorbing element.
Figure 4:
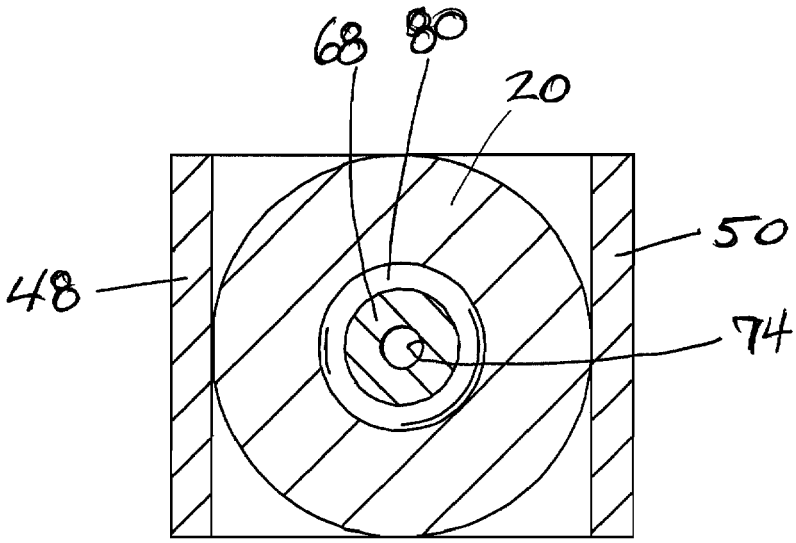
FIG. 4 is a sectional view taken on line 4-4 of FIG. 2.

Referring now to the drawings, FIGS. 1-4 illustrate a solenoid assembly 10 such as may be used in a high wattage application desirable in the commercial laundry industry. The assembly 10 generally comprises a solenoid 12, a pair of permanent latching magnets 14, a plunger 16 movable relative to the solenoid 12 and magnets 14 and a frame 18 for holding the solenoid 12, magnets 14 and plunger 16.

The solenoid 12 includes a bobbin-based electromagnetic coil 20 with a stovepipe portion 22 which together form a cylindrical interior passageway 24. The coil 20 is surrounded with a protective encapsulation 26 (FIG. 1) having a dependent portion 28 for connecting the coil 20 with a source of energizing electrical power via a set of wires 30. A pair of magnets 14 define a magnetic latching arrangement and are positioned against one end of the coil 20 in surrounding relationship with the stovepipe portion 22.

The plunger 16 is slidably moved back and forth in the passageway 24 as power to the coil 20 is applied in a sense that produce fields which respectively aid and oppose the field of the magnets 14. The plunger 16 is substantially cylindrical and includes a main body 32, an outer end 34 having a reduced diameter relative to the main body 32 and an inner end 36 having a generally conical end 38 extending from a circumferential shoulder 40. Plunger 16 has a circumferential notch 42 that holds a retaining ring 44 against one side of a non-magnetic washer 46 which encircles the main body 32.

The frame 18 is constructed from a generally U-shaped rigid member, and includes a pair of spaced sidewalls 48, 50 connected by a back wall 52 having a recess 54. The sidewalls 48, 50 have lengths which extend beyond the combined lengths of the magnets 14 and the coil 20. At least one sidewall 48 is formed with a pair of holes 56 to facilitate mounting of the frame 18. As seen best in FIG. 1, an end plate 58 connects the sidewalls 48, 50 at an end opposite back wall 52. The end plate 58 is formed with an opening 60 for receiving the stovepipe portion 22 that surrounds the plunger 16. The opening 60 is aligned with the passageway 24 of coil 20. Coil spring 62 has one end disposed against an outside surface of the end plate 58, and another end disposed against the face of the washer 46 which is restrained against outer movement by retaining ring 44.

The back wall 52 of the frame includes a separate plug-like backstop 64 which is selectively engaged by the shoulder 40 of plunger 16 upon energization of coil 20. The backstop 64 has a first cylindrical portion 66 which is received in the coil passageway 24 adjacent the back wall 52. The backstop 64 has a second cylindrical portion 68 having a smaller diameter than the diameter of first cylindrical portion 66. The backstop 64 is secured against any inward movement of the coil passageway 24 by a retaining ring 70. The ring 70 is engaged in a circumferential notch 72 formed in the second cylindrical portion 68, and normally abuts an external surface in back wall 52. The backstop 64 is formed with an aperture 74 to release air from the coil passageway 24 during plunger movement, and aid in preventing corrosion of the plunger 16. The aperture 74 opens into a frustoconical portion 76 which is designed to accommodate the conical inner end 38 of plunger 16. The frustoconical portion 76 terminates in a circular inner end 78 of the backstop 64 which is selectively impacted upon by the moving shoulder 40 of the plunger 16.

A resilient dampening element in the preferred form of a compressible, shock absorbing O-ring 80 encircles the second cylindrical portion 68 of the backstop 64. The O-ring 80 is positioned in passageway 24 between the backstop 64 and the back wall 52 of the frame 18 inwardly of the coil 20. It is a function of the O-ring 80 to act as a resilient bumper and cushion the impact between the plunger 16 and the backstop 64 during repeated solenoid operation so as to prevent damage to the plunger 16 particularly along its annular shoulder 40.

Figure 2:
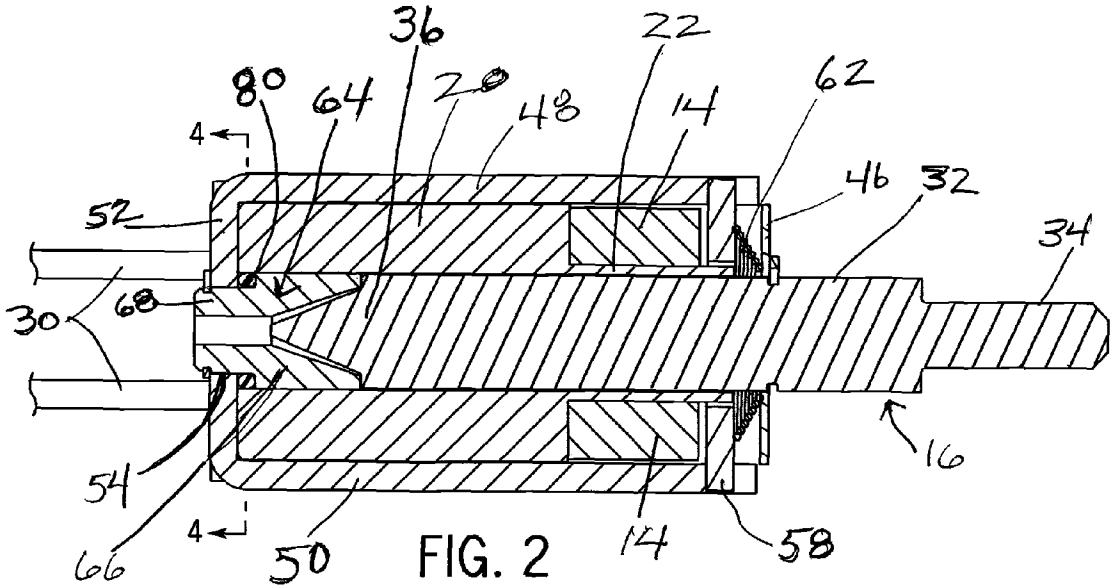
FIG. 2 is a longitudinal sectional view of FIG. 1 showing the solenoid assembly in an energized, latched position.
Figure 3:
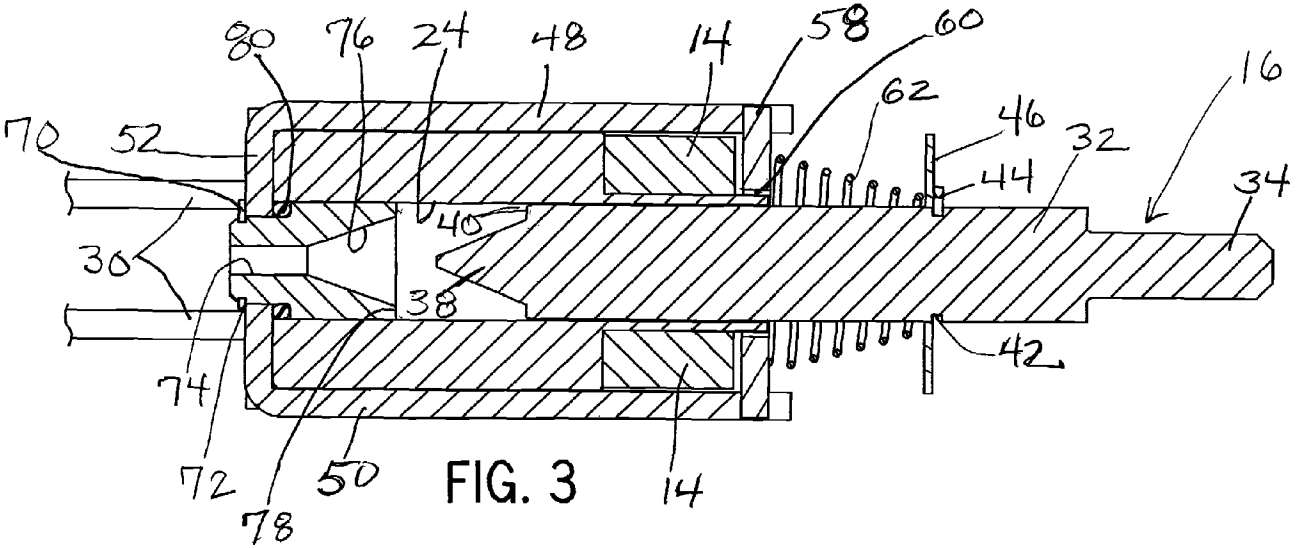
FIG. 3 is a longitudinal sectional view of FIG. 1 showing the solenoid assembly in an de-energized, unlatched position.

In use, the assembly 10 is brought to a latched position shown in FIG. 2 with a momentary energization of the coil 20 in a sense that adds to the field of the magnets 14. The plunger 16 moves in the passageway 24 compressing spring 62 until the shoulder 40 of the plunger 16 impacts upon the inner end 78 of the backstop 64.

In a high wattage application, the plunger 16 moves quickly and forcefully. The impact of loading between the plunger 16 and the backstop 64 can be severe enough to deform the shoulder 40 of the plunger 16 over repeated cycles of use. However, the compression of the shock absorbing O-ring 80 positioned around the movably mounted backstop 64 adjacent the frame back wall 52 enables a temporary small outward deflection of the backstop 64 relative to the back wall 52 which prevents damage to the impact surface of the plunger 16.

Once full impact has occurred between the plunger 16 and the backstop 64, the resiliency of the O-ring 80 will return the backstop 64 to its original position. The plunger 16 is held in its latched position by the force of the permanent magnets 14 alone as power to the coil 20 is removed. The assembly 10 is brought to an unlatched position shown in FIG. 3 with another momentary energization of the coil 20 in a sense that produces a field that opposes the field of the permanent magnets 14 and causes the plunger 16 to move away from the backstop 64. The plunger 16 will reach its full unlatched position as assisted by the released energy of the compressed return spring 62.

It should be appreciated that the present invention thus provides an arrangement particularly useful in protecting the integrity of a plunger continuously subjecting high impact forces upon a backstop in a solenoid assembly. The arrangement relies upon the backstop being movably mounted relative to the frame and provided with an encircling shock absorbing O-ring adjacent the frame to dampen the impact between the plunger and the backstop, and thereby extend the lifetime of the solenoid assembly.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

I claim:

1. A solenoid assembly comprising:

a solenoid having a coil provided with a passageway and a plunger movable within the passageway upon application of electrical power to the coil;

a frame holding the solenoid and including a backstop movably mounted relative to the frame and extending into the coil passageway, the backstop being selectively engaged by the plunger such that the backstop and the plunger are subject to an impact therebetween; and a resilient dampening element positioned in the coil passageway between the frame and the backstop for cushioning the impact between the backstop and the plunger.

2. The solenoid assembly of claim 1, wherein the resilient dampening element is an O-ring encircling the backstop.

3. The solenoid assembly of claim 1, including holding elements for maintaining a prescribed position of the plunger.

4. The solenoid assembly of claim 3, including a pair of permanent magnets surrounding a portion of the coil and positioned adjacent one end of the coil in the frame.

5. The solenoid assembly of claim 3, including a spring positioned between the frame and the plunger.

6. A solenoid assembly comprising:

a solenoid having a coil provided with a passageway, and a plunger movable within the passageway between a latched position and an unlatched position upon application of electrical power to the coil;

a magnetic latching arrangement surrounding the plunger and positioned adjacent the coil for holding the plunger in the latched position;

a frame holding the coil and the magnetic latching arrangement and including a separate backstop movably mounted in the frame and extending into the coil passageway, the backstop being selectively engaged by the plunger such that the backstop and the plunger are subject to an impact therebetween;

a spring surrounding the plunger for normally biasing the plunger to the unlatched position; and a resilient, shock absorbing ring encircling the backstop and positioned between the backstop and the frame for preventing damage to the plunger upon impacting the backstop.

7. The solenoid assembly of claim 6, wherein the magnetic latching arrangement includes a pair of permanent magnets encircling the plunger and a portion of the coil.

8. The solenoid assembly of claim 6, wherein the plunger has a main body, an outer end projecting from the frame and an inner end engageable with the backstop.

9. The solenoid assembly of claim 6, wherein the frame includes a pair of sidewalls connected by a back wall having a recess formed therein.

10. The solenoid assembly of claim 9, wherein the frame further includes an end plate connecting the sidewalls and spaced from the back wall.

11. The solenoid assembly of claim 9, wherein the backstop has a first cylindrical portion positioned in the passageway of the coil, and a second cylindrical portion mounted in the recess of the back wall.

12. The solenoid assembly of claim 8, wherein the inner end of the plunger has a circumferential shoulder engageable with a circular inner end of the backstop.

13. The solenoid assembly of claim 8, wherein the backstop is formed with an aperture which receives a portion of the inner end of the plunger.

14. The solenoid assembly of claim 11, wherein the backstop is restrained from moving inwardly in the passageway by a ring retained on the second cylindrical portion of the plunger and engaged against the frame.

15. The solenoid assembly of claim 11, wherein the shock absorbing ring is located between the first and second cylindrical portions of the backstop.

16. The solenoid assembly of claim 14, wherein the impact between the plunger and backstop causes the ring to compress and enable movement of the backstop.

17. The solenoid assembly of claim 8, wherein a washer surrounds the main body of the plunger.

18. The solenoid assembly of claim 17, wherein the spring has one end positioned against the washer, and another end engaged against the frame.

19. In a solenoid assembly having a solenoid provided with a coil configured with a passageway, a plunger movable within the passageway upon application of electrical power to the coil, and a frame for holding the solenoid and including a backstop extending into the passageway, the backstop being selectively engaged by the plunger to create an impact between the plunger and the backstop, the improvement comprising:

a shock absorbing cushion positioned in the passageway of the coil between the frame and the backstop for dampening the impact between the backstop and the plunger, the impact between the backstop and the plunger causing the cushion to compress and enable movement of the backstop.

* * * * *